United States Patent [19]

Washington

[11] Patent Number: 4,743,798

[45] Date of Patent: May 10, 1988

[54] FLAT CATHODE RAY TUBE HAVING FLEXIBLE, WOVEN CONDUCTORS

[75] Inventor: Derek Washington, Wallington, England

[73] Assignee: U.S. Philips Corporation, New York, N.Y.

[21] Appl. No.: 72,318

[22] Filed: Jul. 13, 1987

[30] Foreign Application Priority Data

Jul. 23, 1986 [GB] United Kingdom ..... 8617963

[51] Int. Cl.[4] ..... H01J 29/70

[52] U.S. Cl. ..... 313/422; 313/477 HC; 174/117 FF

[58] Field of Search ..... 313/51, 50, 422, 477 HC, 313/477 R; 174/117 F, 117 FF, 117 PC; 361/398

[56] References Cited

U.S. PATENT DOCUMENTS 2,958,018 10/1960 Kocmich ..... 174/117 F 3,244,795 4/1966 Latimes ..... 174/117 PC 4,451,756 5/1984 Sato et al. ..... 313/422

*Primary Examiner*—David K. Moore

*Assistant Examiner*—Michael Horabik

*Attorney, Agent, or Firm*—John C. Fox

[57] ABSTRACT

Electrical interconnection between a leadthrough in a cathode ray tube envelope wall and terminals for internal, electrically operable, components such as an electron gun, is established by flexible conductor means comprising a flexible circuit consisting of one or more polyimide films with conductive tracks deposited thereon and, secured to the film(s) to form a single assembly, a further one or more superposed polyimide films having spaced apertures through which at least one conductor element, for example of metal wire or tape, is woven. The conductor element(s) can carry high currents safely and the conductor means is sufficiently thin and flexible to be routed round internal components easily.

9 Claims, 2 Drawing Sheets

FLAT CATHODE RAY TUBE HAVING FLEXIBLE, WOVEN CONDUCTORS

BACKGROUND OF THE INVENTION

This invention relates to a cathode ray tube having an envelope containing electrically operable components comprising at least means for producing an electron beam and flexible conductor means extending between leadthrough means in the wall of the envelope and terminals of the electrically operable components for supplying power thereto, and wherein the conductor means comprises a flexible circuit of at least one film of insulative material on which a plurality of conductive tracks are provided.

Such a cathode ray tube is the subject of British Patent Application No. 8521580 as yet unpublished. The use of a flexible circuit as the conductor means has considerable advantages over conventional discrete wires employed previously as conductor means. The flexible circuit, being thin, occupies very little space in one plane and can easily be routed around the internal structure of the tube. This is particularly advantageous in the case of a flat type of cathode ray tube as described in the aforementioned patent application where internal space is, in view of the nature of the tube, at a premium and in which a comparatively large number of electrically operable components are present in the envelope. Further, as the supply conductors are constituted by conductive tracks, for example thick film tracks, carried on the film, assembly of the tube is greatly facilitated in comparison with the use of conventional separate wires. As is also described in British Patent Application No. 8521580, the flexible circuit may comprise a plurality of films each carrying a number of thick film conductive tracks, the plurality of films being stacked and secured together forming a film assembly. Because each film is flexible and relatively thin, such an assembly of track-carrying films is still comparatively thin and highly flexible and so the advantages discussed above are retained.

Polyimide material is used for the film(s). The thick film conductive tracks are deposited directly on the polyimide film(s), for example using screen printing techniques, and terminations provided at each end of the flexible circuit for connection with pins of the leadthrough means on the one and terminals associated with the internal, electrically operable, components on the other. This construction presents little or no outgassing problems.

This type of conductor means interconnecting the leadthrough means and terminals of internal components has been found to work very well generally. However, where particularly high electrical currents are to be supplied to a certain component, for example an electron gun heater, problems might be experienced and the high currents involved could perhaps lead occasionally to breakdown of the conductive thick film track or tracks concerned.

It is an object of the present invention to provide an improved form of flexible circuit conductor means which can reliably handle the relatively high currents supplied to, for example, an electron gun heater.

SUMMARY OF THE INVENTION

According to the present invention there is provided a cathode ray tube having an envelope containing electrically operable components comprising at least means for producing an electron beam, and flexible conductor means extending between leadthrough means in the wall of the envelope and terminals of the electrically operable components for supplying power thereto, wherein the conductor means comprises a flexible circuit of at least one film of insulative material on which a plurality of conductive tracks are provided, a further film or superposed films of insulative material secured to the said at least one film to form a single assembly, and at least one separate, flexible and elongate conductor element for connection between the leadthrough means and a said terminal which is woven through spaced apertures formed in the further film or superposed films and carried thereby. Preferably, the films are of polyimide material.

The elongate conductor element may comprise a conducting metal wire or tape, the latter having the advantage of thinness so that the overall thickness of the conductor means remains small. The size and nature of the wire and tape are chosen to suit the particular current-handling requirements existing and to avoid any outgassing problems. In this way, the advantages of using a flexible circuit are retained whilst the additional one or more separate conductor elements avoid the need to use the thick film tracks as high current supply lines and readily enable comparatively high currents to be supplied to an internal component or components reliably and without any great risk of breakdown. Even with an additional film(s) and the one or more conductor elements, the conductor means remains sufficiently thin and flexible to be easily accommodated in, and routed through, the envelope. By threading the one or more conductor elements through apertures in the further film(s), no additional means are necessary to attach the elements(s) to the film(s) although some kind of securement at the end or ends of the element(s) can be considered desirable to prevent the possibility of the element(s) becoming unthreaded. Because of the loose nature of the attachment of the element(s) to the film(s) considerable flexbility is achieved without risk of damage being caused to the element(s) and/or film(s).

In the case where two or more such elongate conductor elements are required, the conductor elements may be insulated with suitable covering material and woven through the same set of apertures in the further film(s). However, in a preferred arrangement, the two or more elongate conductor elements are woven through a respective and separate set of spaced apertures in the further film(s), thereby avoiding the need for mutual covering insulation. Also, when two conductor elements are present the two elongate conductor elements are woven through their respective set of apertures in opposite senses and the apertures positioned such that adjacent longitudinal portions of the two conductor elements lie on opposite sides of the film.

The surfaces of the further film, or the outer, exposed, surfaces of the superposed films, together with the one or more conductor elements carried thereby, are preferably covered by insulative material, for example, yet further polyimide films, to prevent any possible shorting between the conductor elements and internal components of the envelope or the tracks carried on the other film(s) of the conductor means. One of these insulating films may conveniently be constituted by an adjacent track-carrying film, the surface of that track-carrying film remote from the tracks being disposed adjacent the conductor element carrying film.

The further film or films carrying the one or more separate conductor elements is conveniently secured to the one or more other track-carrying films by metal fastening elements, for example swaged eyelets. Respective ones of such metal fastening elements may be passed through the ends of the conductor element(s) and at least the further film to secure the ends of the conductor element(s) to the further film and used as terminations therefor.

BRIEF DESCRIPTION OF THE DRAWINGS

An embodiment of a cathode ray tube in accordance with the present invention will now be described, by way of example, with reference to the accompanying drawings in which.

DESCRIPTION OF THE PREFERRED EMBODIMENTS

Figure 1:
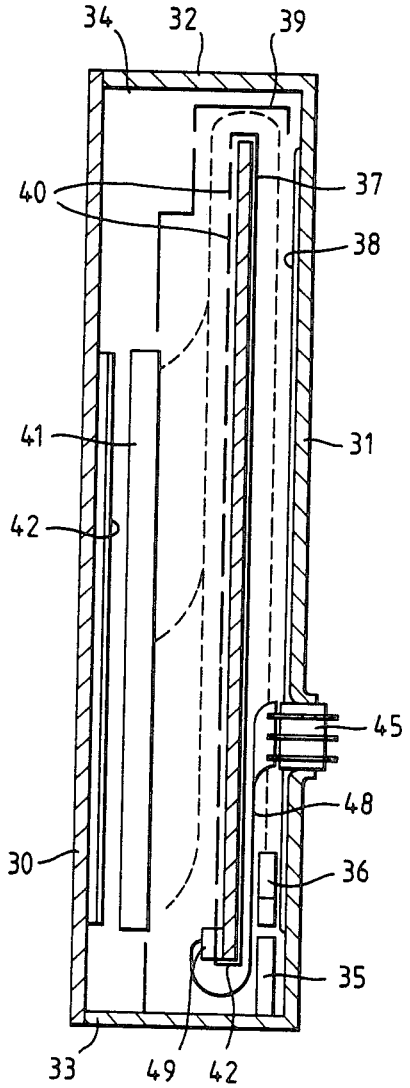
FIG. 1 is a diagrammatic sectional view through the tube.

Referring to FIG. 1, the tube shown is an example of a so-called "flat-tube". The construction and operation of this tube is described in detail in published British Patent Application No. 2,101,396A, corresponding to U.S. patent application Ser. No. 830,388, filed Feb. 14, 1986, whose disclosure is incorporated herein by reference. For the sake of brevity, the tube will not be described herein in detail. Briefly however, the tube comprises an envelope formed by a front plate glass faceplate 30, a rear wall 31, top and bottom walls 32 and 33, and two side walls, of which only side wall 34 is visible in the figure. Apart from the faceplate, the walls are all formed of mild steel. An electron gun 35 is arranged to produce a low-current, low voltage electron beam which is directed parallel to the faceplate 30 adjacent the rear wall 31.

The beam undergoes line scanning using electrostatic deflector plates 36 and passes through a field-free space produced by electrodes 37 and 38 before being turned through 180 degrees by a reversing lens 39. By means of a series of generally parallel electrodes 40, a varying electric field is produced between the electrodes 40 and the input of a channel plate electron multiplier 41 to achieve frame scanning over the input of the multiplier. The current multiplied beam is accelerated toward a phosphor screen 42 carried on the faceplate 30 by a field established between the outPut of the multiplier and a screen electrode.

Figure 2:
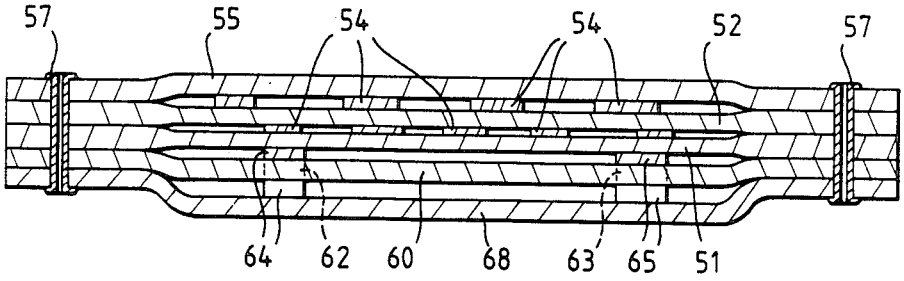
FIG. 2 is a sectional view through a multi-film conductor means of the tube for interconnection between a multi-pin leadthrough in the tube's envelope wall and terminals within the envelope associated with electrically-operable components within the tube.

The electron run 35, deflector plates 36 and electron multiPlier 41 are mounted adjacent a central glass-plate partition 42, such mounting not being shown in the schematic representation of FIG. 2 for simplicity. The electrode 37 and frame deflection electrodes 40 are applied directly to opposite surfaces of this partition.

A circular multi-pin leadthrough 45 is mounted in a vacuum-tight manner in the rear wall 31. Electrical connection with the internal components of the tube is established from outside the envelope via this multi-pin leadthrough 45. Conductor means 48 including a flexible circuit constituted by an insulative film or films of polyimide material on which a plurality of conductor tracks are deposited running along its length is connected at its one end to the leadthrough 45 and extends downwardly adjacent one side of the envelope around the end of the partition 42 and is connected at its other end to an in-line terminal block 49 mounted on the partition 42. The terminal block is electrically connected by relatively short conductors (not shown) to the electron gun 35, deflector plates 36, electron multiplier 41 and screen electrode. The conductor means 48 is thin, light and, is readily flexible so that it is easily routed around the internal supporting structure of the envelope to the terminal block 49. Electrical connection with the internal components of the tube is established from outside the envelope via this multi-pin leadthrough 45. A similar flexible conductor means (not visible in FIG. 1) may be connected between a further multi-pin leadthrough mounted in the rear wall 31 and a terminal block carried on the partition 42, this block being connected to the electrodes 37 and 38, reversing lens 39, and frame deflection electrodes 40. Alternatively, the conductor means 48 may divide along its length so as to form two (or more) branches each having conductive tracks which are connected to two (or more) terminal blocks associated respectively with separate internal components.

Upon connection of the multi-pin leadthrough 45 to a suitable source, electrical potential and control voltages are supplied via the leadthroughs and the conductor means and terminal block to the internal components of the tube to operate the tube, the operation being described in aforementioned published British Patent Application No. 2101396A.

Referring now to FIG. 2 there is shown a cross-section through one form of conductor means 48 as used in the tube. This particular form of conductor means comprises two elongate layers of polyimide film 51 and 52, each carrying a plurality of conductive tracks running along their length, generally designated 54. The layers are superposed on top of one another in a stack to form a laminate structure with the conductive tracks on the film 51 being covered and protected by the undersurface of the adjacent film 52. The conductive tracks 54 on the uppermost film 52 are enclosed and protected by a plain polyimide film 55 covering the upper surface of film 52.

Each conductive track-carrying film is fabricated by coating a film of Kapton (Trade Mark) of around 50 to 100 micrometers thickness and 3 cms wide with a conductive metallic film pattern defining the conductor tracks using conventional evaporation, sputtering, or thick film techniques. Kapton is a polyimide film synthesised by a polycondensation reaction between an aromatic tetrabasic acid and an aromatic amine. The conductor tracks, around 1 to 6 micrometers (depending on the material) in thickness and 1 to 2 mm wide with enlarged ends for connection purposes and spaced apart by around 2 to 3 mm, can be either defined at the conductive film deposition stage, or defined later by a photolithographic process. The conductive film is applied directly on the surface of the polyimide film and may comprise nickel, gold, aluminium, copper, or a flexible thick film conductive ink such as a silver organo-metallic ink.

In a preferred method, the polyimide film was preshrunk by baking so as to avoid any problems as a result of the film shrinking when the tube is eventually subjected to a baking operation, and then cut to the appropriate shape and cleaned thoroughly. The desired pattern of tracks was then deposited directly onto the film by thick film screen printing using a silver-based type thick film conductive ink such as thick film ink available under the Trade Name P110 from Johnson Matthey or ESL 9090 (Trade Name) silver organo-metallic ink, both of which remain flexible when baked. The printed pattern was allowed to settle for 15 minutes and was then dried at 125 degrees Celcius for 45 minutes. This was followed by baking in a box furnace at 350 degrees Celcius for 1 hour. The resultant conductive tracks, which have a resistance of around 50 milliohm/cm of line in the case of P110 thick film ink, were found to be well bonded to the Kapton film, sufficiently flexible and did not exhibit any appreciable outgassing during subsequent operations of tube assembly.

The conductive tracks 54 extend longitudinally of their supporting polyimide film and are shaped and positioned with respect to one another at their ends so as to enable connection with the associated multi-pin leadthrough and terminal block(s).

The conductor means also includes a further film 60 of insulative polyimide material similar to the films 51, 52 and 55 and superposed therewith which has two sets of spaced apertures 62, 63 along its length with a respective flat, elongate conductor element 64, 65 of thin, flexible and un-insulated nickel tape passing through each set of apertures alternately from one side to the other side of the film 60 in woven fashion. The film 60 is shown in plan view in FIG. 3. As can be seen, the two sets of apertures 62, 63 are spaced apart widthwise of the film 60, by approximately 2 cms, the spacing between adjacent apertures in each set being around the same value, and the tapes are threaded through the apertures such that adjacent portions of the tapes 64 and 65 lie on opposed sides of the film 60.

Although the conductor elements 64, 65 are provided as separate components, by weaving them through apertures in the film 60, the film 60 and conductor elements 64, 65 in effect act as a single sub-assembly.

A circular array of apertures, in registration with corresponding circular arrays of apertures in the other films, are provided at one end of the films to enable contact to be made between the conductive tracks 54 and tapes 64, 65 and the pins of the leadthrough 45. Similarly, at the other end of the films, two linear arrays of apertures are provided to enable contact to be made between the tracks 54 and elements 64, 65 and the pins of the terminal block 49.

Referring again to FIG. 2, one surface of the film 60 is covered by the plain surface of adjacent film 51 whilst the other side is covered by a plain film of polyimide 68.

The plurality of layers of the conductor means are fastened together to form a single assembly by swaged eyelets 57 passing through their marginal portions at regular intervals along their length. Swaged eyelets may also be used as fasteners at the ends of the conductor means. Conveniently respective ones of these end eyelets are passed through the ends of the conductor elements 64, 65 carried by the film layer 60 so as to connect electrically therewith. Alternatively, separate eyelets associated with the film 60 may be used, these eyelets, whose heads are indicated at 70 in FIG. 3, passing only through the film 60 and the ends of elements 64 and 65. The exposed heads of the eyelets, are then used as terminals for connection with associated pins of the multi-pin leadthrough and terminal block(s) by spot welding or soldering. These eyelets serve also to secure the ends of the elements 64, 65 on the film 60 preventing them from becoming unthreaded. A similar form of termination using eyelets may be provided for the tracks 54.

It will be appreciated that even with five polyimide film layers, a plurality of conductive tracks 54 and the conductor elements 64, 65, the conductor means still occupies only very little space in one plane and, being thin and flexible can readily be routed around components within the envelope, thus easing assembly. Where branching is required, the five films may be branched at a convenient point along the length of the conductor means, each branch thus having five films, or alternatively individual conductive track-carrying and conductor element-carrying films may be separated where necessary and extend independently of the other films to respective terminal blocks.

Although in the embodiment described above, the conductor elements 64 and 65 are carried by a single film 60, the elements may instead be woven through respective sets of spaced apertures in two, or more, polyimide films directly superposed with the apertures in each film registering with the apertures in the other film or films. The two or more films act in effect as a single, thicker, film and provide increased stiffness, whilst still being sufficiently flexible, to facilitate the element weaving process. Of course a single film of increased thickness may instead be used to provide this stiffness if required.

Depending on the number of comparatively high current supplies necessary, the film 60 may carry just one, or more than two, conductor elements as described.

Figure 3:
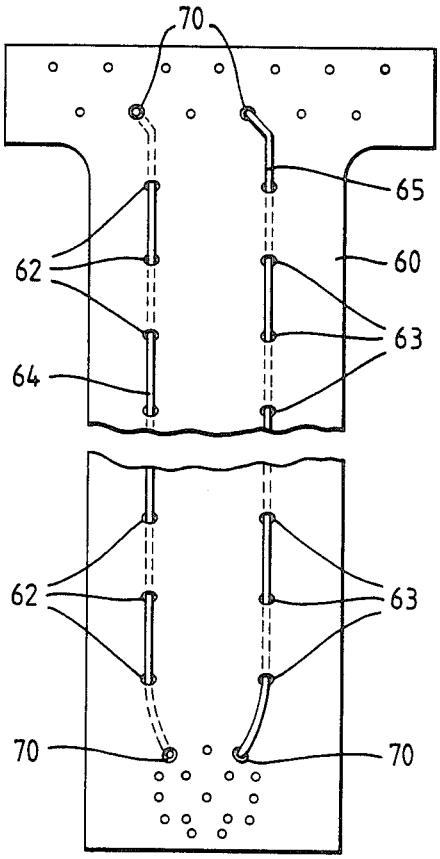
FIG. 3 is a plan view of one film of the conductor means of FIG. 2 prior to final assembly with the other films.

Moreover, although the conductor means described with reference to FIG. 3 comprises two conductive track-carrying polyimide films, one or more than two track-carrying films may be used depending on the number of separate tracks needed for connection with the electrically-operable internal components of the tube. For example, if only a few conductive tracks are required and/or available space within the envelope is sufficient to accommodate a comparatively wide film size, only one conductive track-carrying film may be necessary, this being covered by a further polyimide film so as to enclose the conductive tracks with the conductor element carrying film arranged adjacent its other side and this film, in turn, being covered by another, plain, film.

Although a specific form of cathode ray tube has been described herein, it will be appreciated that the conductor means described for achieving interconnection between a leadthrough in the wall of the tube's envelope and internally disposed electrically-operable components may be employed in other forms of cathode ray tubes where such interconnection is required.

I claim:

1. A cathode ray tube having an envelope containing electrically operable components comprising at least means for producing an electron beam, and flexible conductor means extending between leadthrough means in the wall of the envelope and terminals of the electrically operable components for supplying power thereto, wherein the conductor means comprises a flexible circuit of at least one film of insulative material on which a plurality of conductive tracks are provided, a further film or superposed films of insulative material secured to the said at least one film to form a single assembly, and at least one separate, flexible and elongate conductor element for connection between the lead-through means and the terminal which is woven through spaced apertures formed in the further film or superposed films and carried thereby.

2. A cathode ray tube according to claim 1, wherein the at least one conductor element comprises metal wire.

3. A cathode ray tube according to claim 1, wherein the at least one conductor element comprises a flat metal tape.

4. A cathode ray tube according to claim 1 and having at least two elongate conductor elements, wherein the conductor elements are woven through a respective and separate set of spaced apertures in the further film or superposed films.

5. A cathode ray tube according to claim 4, wherein the two elongate conductor elements are woven through their respective set of spaced apertures in opposite senses and the apertures positioned such that adjacent longitudinal portions of the two conductor elements lie on opposite sides of the film or superposed films.

6. A cathode ray tube according to claim 1, wherein the said at least one film and the said further film or superposed films comprise polyimide films.

7. A cathode ray tube according to claim 1, wherein the surfaces of the further film or outer surfaces of the superposed films, together with the one or more conductor elements carried thereby, are covered by insulative material.

8. A cathode ray tube according to claim 7, wherein the insulative material comprises films of polyimide.

9. A cathode ray display tube according to claim 1, wherein metal fastening elements are used to secure the ends of the at least one elongate conductor element to the further film or superposed films, the metal fastening elements acting as terminations therefor.

* * * * *